US005743444A

United States Patent [19]

Beck et al.

[11] Patent Number: 5,743,444

[45] Date of Patent: Apr. 28, 1998

[54] TWIST DISPENSING CLOSURE

[75] Inventors: James M. Beck, Buffalo Grove; John Sekowski, Long Grove, both of Ill.

[73] Assignee: Creative Packaging Corp., Buffalo Grove, Ill.

[21] Appl. No.: 761,395

[22] Filed: Dec. 6, 1996

[51] Int. Cl.[6] ..... B65D 47/06

[52] U.S. Cl. ..... 222/521

[58] Field of Search ..... 222/519–521, 222/549

[56] References Cited

U.S. PATENT DOCUMENTS

| | | | |
|---|---|---|---|
| 2,589,206 | 3/1952 | Tegarty | 222/521 X |
| 2,769,582 | 9/1956 | Schlicksupp | 222/521 X |
| 3,370,764 | 2/1968 | Stull | 222/521 X |
| 3,407,967 | 10/1968 | Stull | 222/521 X |
| 4,065,037 | 12/1977 | Haller | 222/521 X |
| 4,424,918 | 1/1984 | Stull | 222/521 X |
| 4,477,002 | 10/1984 | Stull | 222/521 |
| 4,754,899 | 7/1988 | Stull | 222/521 |
| 4,823,994 | 4/1989 | Laauwe | 222/521 |
| 4,967,941 | 11/1990 | Beck | 222/521 |
| 5,044,530 | 9/1991 | Stull | 222/521 |
| 5,111,977 | 5/1992 | Maguire et al. | 222/521 |
| 5,135,139 | 8/1992 | Krawagna | 222/520 |
| 5,135,140 | 8/1992 | Maguire et al. | 222/521 |
| 5,284,272 | 2/1994 | Wei | 222/521 X |
| 5,284,277 | 2/1994 | Leuenberger | 222/521 |
| 5,421,487 | 6/1995 | Moretti | 222/521 X |

FOREIGN PATENT DOCUMENTS

| | | | |
|---|---|---|---|
| 405032262 | 2/1993 | Japan | 222/521 |

*Primary Examiner*—Kevin P. Shaver

*Attorney, Agent, or Firm*—Silverman, Cass & Singer, Ltd.

[57] ABSTRACT

A twist dispensing closure including a spout part matingly engageable with a base part adapted to be secured to the neck of a container holding product to be dispensed. The base part includes upstanding cam followers for engagement with ramps formed by channels provided on the inner surface of the spout part. Rotation of the spout part with respect to the base part causes the cam followers to ride on the ramps and thereby move the spout part away from the base part from a closed condition of the spout to an opened condition, thereby permitting dispensing of product through the spout.

7 Claims, 3 Drawing Sheets

TWIST DISPENSING CLOSURE

BACKGROUND OF THE INVENTION

1. Field of the Invention

This invention relates generally to dispensing closures, and more particularly, to such closures having a twist dispensing spout to open and close such closures.

2. Description of the Prior Art

Closures having a twist dispensing spout part and a matingly engageable base part are known. One such closure is disclosed in U.S. Pat. No. 4,967,941 which is assigned to the same assignee as the present application.

In said U.S. Pat. No. 4,967,941, a twist spout or cap is mounted to a base by a helical ramp formed on a central post located on the base which is matingly engageable with threads formed on the inner surface of the cap. Twisting of the cap with respect to the base causes the cap to move from a position in which the closure is in closed condition to an open condition of said closure.

It is desirable to provide structure alternative to the ramp and threads of said prior art patent which can facilitate such open and closed condition of the closure by twist action of the dispensing spout. Such alternative structure preferably obviates the need for cooperative ramp and thread elements between the central post of the base and inner surface of the cap. Elimination of the cooperative elements at the location of the central post permits the closure to be formed with spouts having a wide variety of external and internal reduced-dimension configurations which may not readily be provided with the structure of said U.S. Pat. No. 4,967,941.

SUMMARY OF THE INVENTION

The invention is characterized by a closure including a base part and a matingly engageable twist dispensing spout part. The base part has a central post and the spout part has an aperture to be engaged by the post when the closure is in closed condition. Upstanding cam followers are positioned spaced from the post about the outboard circumference of the base part which is intended to be secured to the neck of a container having product to be dispensed. The inner circumferential surface of the spout part, also spaced from the post, is formed with ramps providing channels that are engaged by the cam followers. When the spout part is twisted with respect to the base part, the cam followers ride on the ramps to move the aperture of the spout part out of engagement with the central post, thereby opening the closure to permit dispensing of product through the aperture.

DESCRIPTION OF THE PREFERRED EMBODIMENTS

Figure 1:
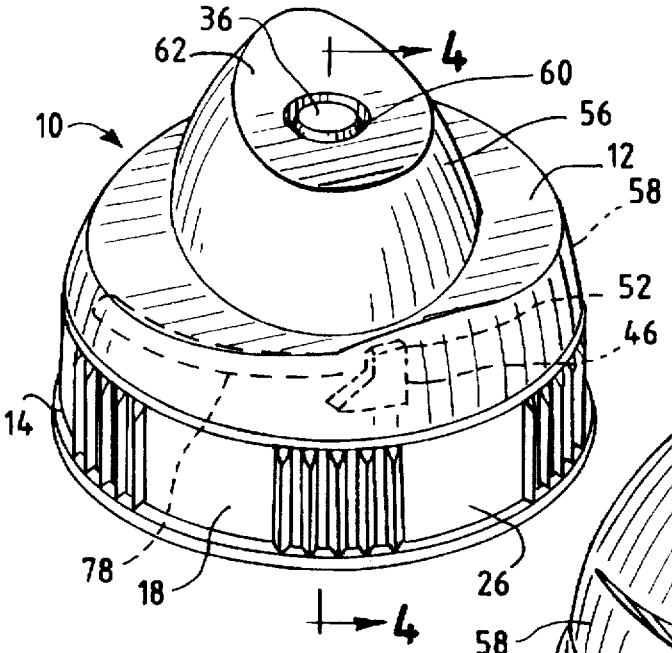
FIG. 1 is a perspective view, partially in phantom outline, of the twist dispensing closure of the invention, the same being illustrated in closed condition.

The twist dispensing closure 10 of the invention includes a spout part 12 and an associated base part 14 intended to be affixed to the neck of a container (not shown) holding product to be dispensed. The base part 14 can be affixed to the container neck by threads 16 or any other known engagement means.

Base part 14 includes a circumferential skirt 18 on the inner surface 20 of which are the threads 16, and a horizontal platform surface 22 which is illustrated in generally circular configuration with a circumference 24 about which the horizontal surface 22 is joined to the external surface 26 of skirt 18. A metering post 28 is formed on the base part 14 upstanding from horizontal surface 22 at the proximate central location thereof. Post 28 includes a passageway 30 which opens at one end 32 thereof to the bottom side of surface 22, and thereby into the container upon which the closure is intended to be mounted. The opposite terminal end 34 of post 28 is formed with an upstanding extension dome 36 secured to the terminal end 34 by spokes 40 which enable passage of product in the container on which base part 14 is affixed through open end 32 of post 28 and the passageways 42 which are present between spokes 40 and the circumferential wall 44 of post 28.

Base part 14 has formed on the horizontal platform surface 22 proximate the circumference 24 a pair of upstanding cam followers 46. Although two cam followers 46 are illustrated, more or less than two may be included within the contemplated scope of the invention.

Each cam follower 46 includes an extension part 48 secured at its base end 50 to the surface 22, and terminating at its free end 52 with a channel engagement part 54, illustrated in generally rounded configuration. It is to be understood that other configurations of the cam followers 46, including the base and free ends, are possible within the contemplated scope of this invention.

The cam followers specifically are positioned on the base part 14 at a distance spaced from the post 28 and are operable in conjunction with the spout part as hereinafter described without engagement with said post.

Spout part 12 is formed with an upstanding generally inverted cup-shaped portion 56 and a skirt portion 58 depending from the cup-shaped portion. An aperture 60 is formed in the cup-shaped portion 56 at the top surface 62 thereof. The aperture 60 opens to the inner surface 64 of spout part 12, and is adapted for cooperative engagement with dome 36 on base part 14 to block aperture 60 when the dome 36 is engaged within aperture 60.

A depending flange 65 is formed on the inner surface of spout part 12 and surrounds post 28 when the spout part is positioned upon base part 14. Inner facing ring 68 on flange 65 engages below lip 70 on post 28 and shoulder 72 also on post 28 to define the length of movement of spout part 12 with respect to base part 14. Said length of movement also is defined by the length of surface 74 on post 28.

Inner-facing surface 76 of skirt portion 58 of spout part 12 has formed thereon a pair of inclined ramps 78 which define respective channels 80. In the illustrated embodiment, there are two channels 80, but more or less than two may be included within the scope of the invention. It is necessary only that there be a sufficient number of channels to engage the cam followers 46 which are provided on base part 14.

Figure 3:
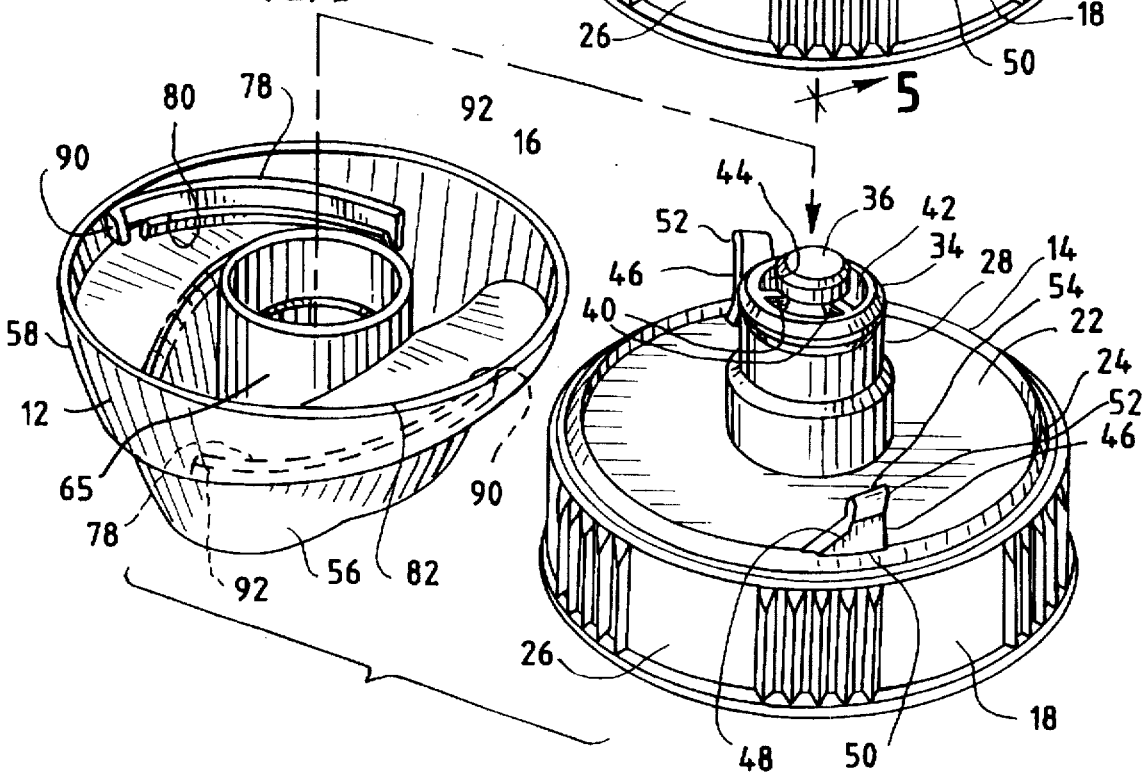
FIG. 3 is an exploded perspective view of the spout part and base part of the invention illustrating the cooperative cam followers and channel forming ramps thereof.

Each channel 80 extends in incline manner from a first location 90 proximate the peripheral edge 82 of skirt portion 58 (FIG. 3) to a second location 92 spaced from said peripheral edge 82. Each channel 80 also is of a cross-sectional configuration which is complementary to the configuration of free end 52 of cam followers 46. When spout part 12 is positioned upon base part 14, each free end 52 of cam followers 46 engages within a respective channel 80.

Figure 2:
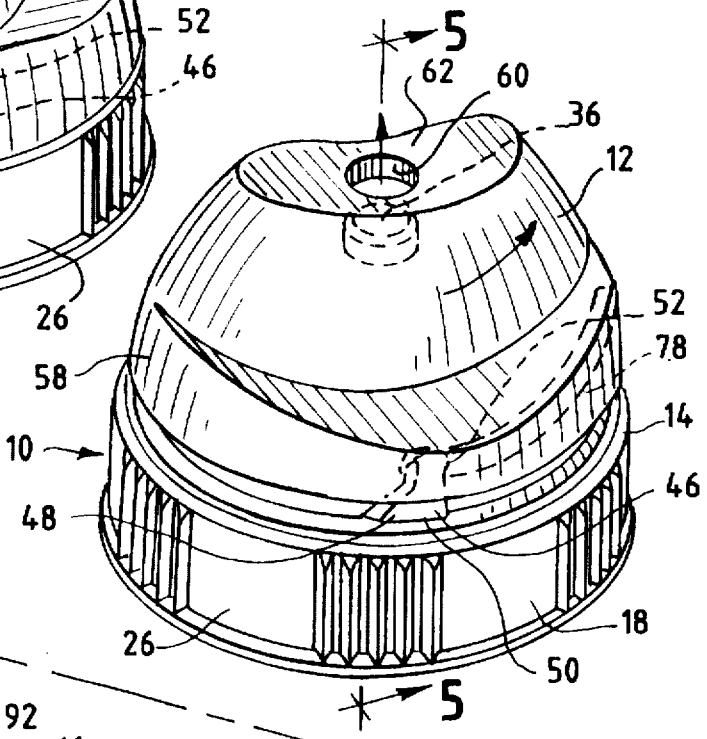
FIG. 2 is a perspective view similar to that of FIG. 1 in which the spout part is illustrated in open condition on its associated base part.
Figure 4:
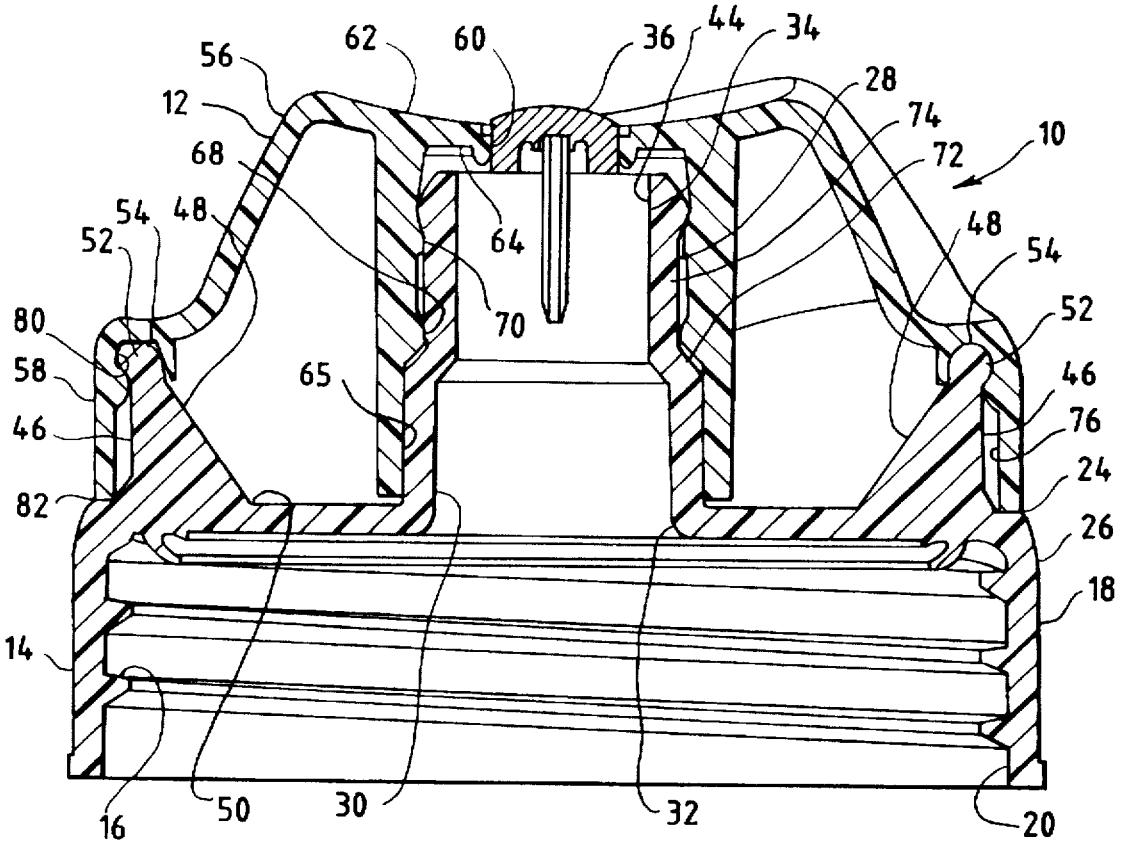
FIG. 4 is a sectional view taken along the line 4—4 of FIG. 1, in the direction indicated generally.
Figure 5:
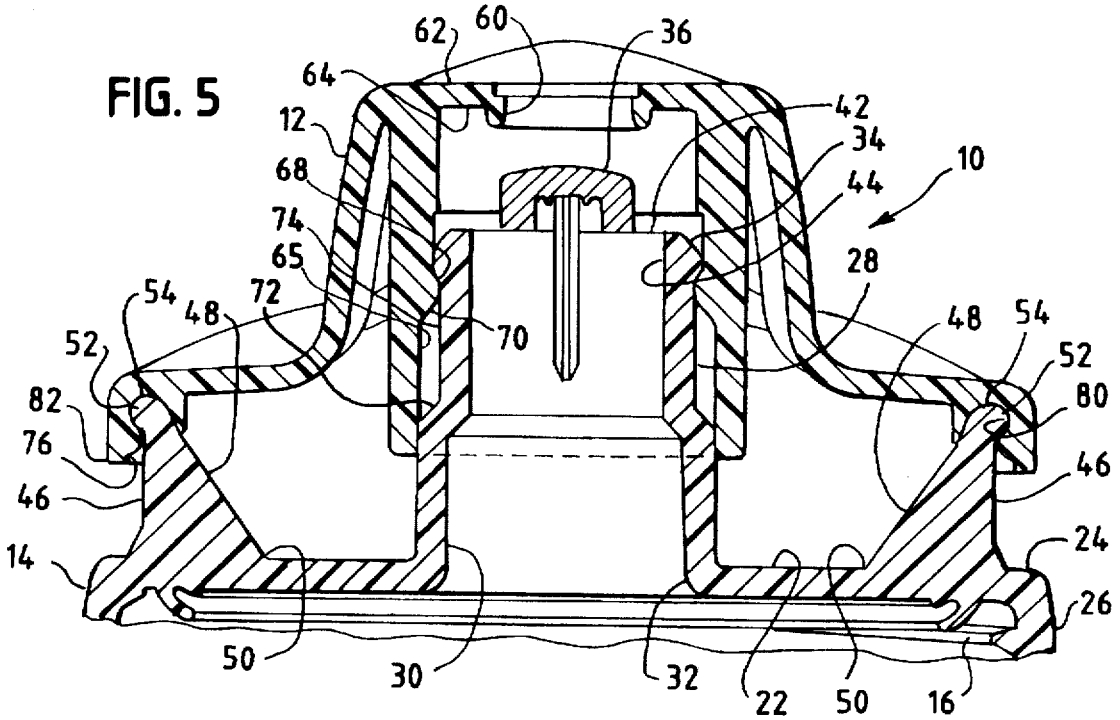
FIG. 5 is a sectional view taken along the line 5—5 of FIG. 2, in the direction indicated generally.
Figure 6:
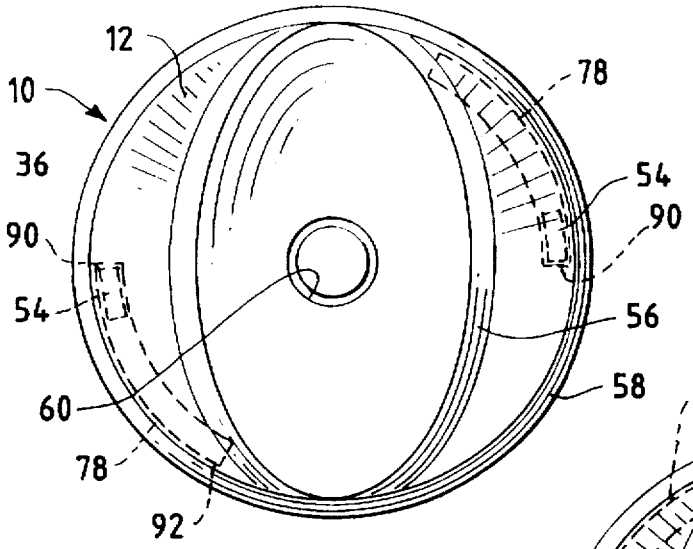
FIG. 6 is a top plan view of the twist dispensing closure of the invention showing ramps and cam followers thereof in phantom outline and arranged for counter-clockwise opening operation of said spout part with respect to its associated base part.

When spout part 12 is positioned in closed position as shown in FIGS. 1 and 4, channel engagement parts 54 of cam followers 46 are positioned within channels 80 proximate location 92 spaced from peripheral edge 82 of skirt portion 58. In this location, spout part 12 is drawn close to base part 14 with peripheral edge 82 located proximate to skirt 18 of base part 14, and dome 36 of post 28 is positioned within aperture 60 to close same and prevent product from being dispensed through closure 10. Rotation of spout part 12 with respect to base part 14 causes channel engagement parts 54 of cam followers 46 to ride in channels 80 to location 90 proximate peripheral edge 82 of skirt portion 58. Spout part 12 thereby is separated from base part 14 and aperture 60 is moved away from dome 36 to open same and permit product to be dispensed through closure 10 (FIGS. 2 and 5).

Figure 7:
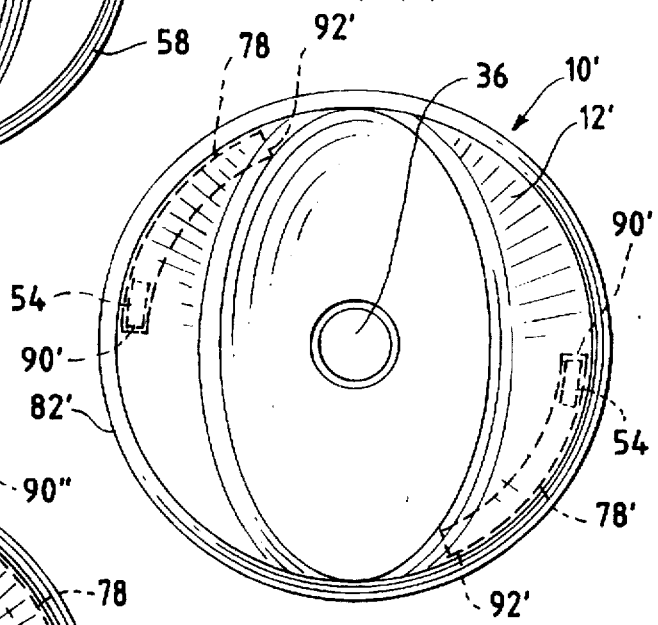
FIG. 7 is a view similar to that of FIG. 6 showing an alternate embodiment in which the ramps and cam followers are arranged for clockwise opening operation of the spout part with respect to its associated base part.

In the preferred embodiment illustrated in FIGS. 1–6, spout part 12 is separable from base part 14 by rotation of the spout part in a counter-clockwise direction with respect to base part 14. The invention also contemplates that such separation can be effected by rotation of alternate spout part 12' in a clockwise direction with respect to base part 14. This alternate embodiment is illustrated in FIG. 7 where the ramps 78' are inclined so that channel engagement parts 54 move from a location 92' proximate peripheral edge 82' to location 90' spaced from peripheral edge 82'. In all other respects, the structure of closure 10' is the same as that disclosed in the preferred embodiment.

Figure 8:
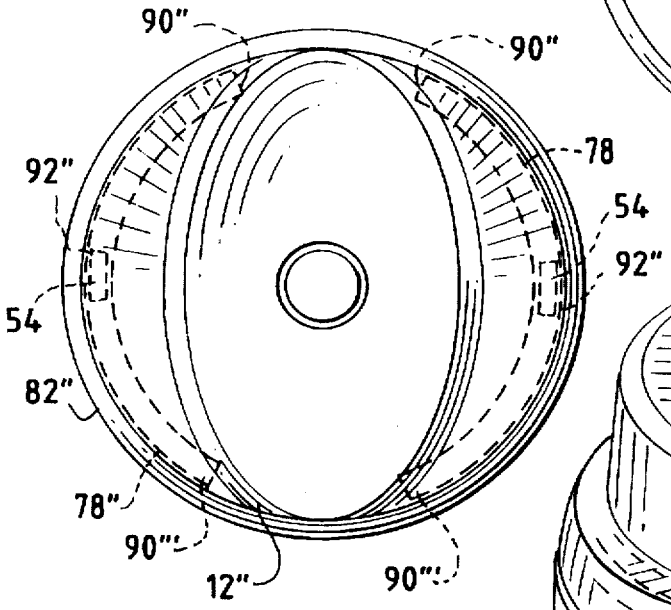
FIG. 8 is a view similar to that of FIGS. 6 and 7 showing a further alternate embodiment in which the ramps and cam followers are arranged for either counter-clockwise or clockwise opening operation of the spout part with respect to its associated base part.

In another embodiment illustrated in FIG. 8, the spout part 12" is provided with ramps 78" which incline from a first location 90" proximate peripheral edge 82" to a second location 92" spaced from peripheral edge 82", and continue in incline fashion to a third location 90'" also proximate to peripheral edge 82", but at a distance circumferentially spaced from location 90". In the embodiment of FIG. 8, spout part 12" may be separated from base part 14 by rotation in either clockwise or counter-clockwise direction. Spout part 12" is in closed condition when channel engagement parts 54 are in the location shown in FIG. 8 proximate location 92" spaced from peripheral edge 82". When twisted in either direction, channel engagement parts 54 move to location 90" or 90'" to separate spout part 12 from base part 14.

Figure 9:
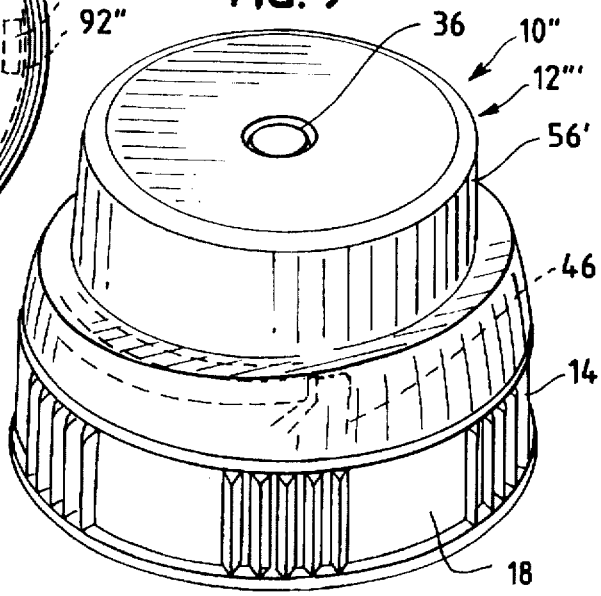
FIG. 9 is a perspective view similar to that of FIG. 1 illustrating an alternate external configuration of the spout part.

The external and resultant internal configuration of cup-shaped portion 56 can take any of a wide range of shapes by reason of the location of cam followers 46 spaced from post 28. For example, FIG. 9 illustrates an alternate embodiment of spout part 12'" in which cup-shaped portion 56' is of a configuration which is different from that of cup shaped portion 56 shown in the other embodiments. In all other respects, including the configuration of skirt 18 of spout part 12, the closure 10" of FIG. 9 is the same as that previously disclosed.

Other modifications and variations of the present invention are possible in light of the above teachings. It is therefore to be understood that within the scope of the appended claims, the invention may be practiced otherwise than as specifically described.

We claim:

1. A twist dispensing closure comprising, a base part adapted to be affixed to a container holding product to be dispensed, a spout part matingly engageable with said base part and movable thereon from an opened position to a closed position, said base part including a platform with a centrally located post, at least one cam follower positioned on and extending above said platform at a location spaced from said post, said spout part having a depending skirt with a terminal edge and an internal surface, at least one channel provided on said internal surface extending along an incline from a first location proximate the terminal edge to a second location spaced from said terminal edge, said cam follower being matingly engageable within said channel, whereby rotation of said spout part with respect to said base part will cause said cam follower to move within said channel and thereby separate the spout part from the base part to open the spout and permit product to be dispensed through the closure.

2. A closure as claimed in claim 1 in which the channel is formed by an inclined ramp.

3. A closure as claimed in claim 1 in which the spout part is moved to said opened position by counter-clockwise rotation with respect to said base part.

4. A closure as claimed in claim 1 in which the spout part is moved to said opened position by clockwise rotation with respect to said base part.

5. A closure as claimed in claim 1 in which the channel extends from said second location to a third location proximate the terminal edge but spaced from said first location.

6. A closure as claimed in claim 5 in which the spout part is moved to said opened position by either clockwise or counter-clockwise rotation with respect to said base part.

7. A closure as claimed in claim 1 which there are two channels and two respective cam followers.

* * * * *